US008277876B1

(12) United States Patent
Butz

(10) Patent No.: US 8,277,876 B1
(45) Date of Patent: Oct. 2, 2012

(54) UV CAMOUFLAGE SYSTEM

(75) Inventor: Scott A. Butz, Fargo, ND (US)

(73) Assignee: Reel Wings Decoy Company, Inc., Fargo, ND (US)

( * ) Notice: Subject to any disclaimer, the term of this patent is extended or adjusted under 35 U.S.C. 154(b) by 1119 days.

(21) Appl. No.: 12/142,483

(22) Filed: Jun. 19, 2008

(51) Int. Cl.
*B05D 5/06* (2006.01)

(52) U.S. Cl. ..... 427/160; 427/162

(58) Field of Classification Search ..... 427/160, 427/162

See application file for complete search history.

(56) References Cited

U.S. PATENT DOCUMENTS

| | | | | |
|---|---|---|---|---|
| 3,300,325 | A | 1/1967 | Lindquist | |
| 4,267,453 | A | 5/1981 | Kieboom et al. | |
| 4,767,649 | A | 8/1988 | Birch | |
| D299,188 | S | 1/1989 | Norton | |
| D299,793 | S | 2/1989 | Yacovella | |
| 4,845,872 | A | 7/1989 | Anderson | |
| 4,868,019 | A | 9/1989 | Knickerbocker | |
| 5,043,202 | A | 8/1991 | Knickerbocker | |
| D320,506 | S | 10/1991 | Nasser | |
| 5,079,048 | A | 1/1992 | Anitole | |
| 5,134,025 | A | 7/1992 | Zenda et al. | |
| 5,293,709 | A | 3/1994 | Cripe | |
| 5,409,760 | A | 4/1995 | Neitz et al. | |
| D366,154 | S | 1/1996 | Bick et al. | |
| 5,756,180 | A * | 5/1998 | Squires et al. | 428/90 |
| 6,115,953 | A | 9/2000 | Wise | |
| 6,374,530 | B1 | 4/2002 | Mierau | |
| 6,555,608 | B2 | 4/2003 | Takahashi et al. | |
| D499,558 | S | 12/2004 | McGahee | |
| 6,859,983 | B2 | 3/2005 | Curtis et al. | |
| D526,790 | S | 8/2006 | Sparkes | |
| D527,191 | S | 8/2006 | Sparkes | |
| 2004/0202846 | A1 * | 10/2004 | Conk | 428/195.1 |
| 2006/0117637 | A1 | 6/2006 | Jeckle | |
| 2006/0121166 | A1 | 6/2006 | Jeckle | |
| 2006/0222827 | A1 | 10/2006 | Marshall et al. | |
| 2007/0199228 | A1 * | 8/2007 | Johnson | 43/3 |

OTHER PUBLICATIONS

Definition of camouflage, Merriam-Webster online, accessed Apr. 18, 2012.*

Bird Vision, U.S. Trademark Application, Serial No. 77011171.

Uvision, U.S. Trademark Application, Serial No. 77027608.

Du Pont, "Elvanol" Polyvinyl Alcohol All in Synonym List NOL001B, DuPont Material Safety Data Sheet.

Dietrich Burkhardt, UV Vision: a bird's eye view of feathers, Journal of Comparative Physiology A: Neuroethology, Sensory, Neural, and Behavioral Physiology, Nov. 1989.

Twilight Labs, Featured Products, website <available at http://www.decoypaint.com>, Sep. 6, 2007.

Twilight Labs, Individual Colors, website <available at http://www.decoypaint.com/articles.asp?=124>, Sep. 6, 2007.

Twilight Labs, UV Photography, website <available at http://www.decoypaint.com/articles.asp?=122>, Sep. 6, 2007.

Twilight Labs, Snow Goose and Blue Goose UV Images, website <available at http://www.decoypaint.com/articles.asp?=121>, Sep. 6, 2007.

(Continued)

*Primary Examiner* — Timothy Meeks
*Assistant Examiner* — Elizabeth Burkhart
(74) *Attorney, Agent, or Firm* — Michael S. Neustel

(57) ABSTRACT

A UV camouflage system for effectively camouflaging an individual or structure with respect to birds. The UV camouflage system generally includes identifying a landscape pattern for camouflage, identifying the color and UV reflection properties of the landscape pattern, and printing a UV camouflage pattern on an item that emulates the color and UV reflection properties of the landscape pattern.

18 Claims, 3 Drawing Sheets

OTHER PUBLICATIONS

Twilight Labs, Learn about the Science of UVision, website <available at http://www.decoypaint.com-s/14.htm>, Sep. 6, 2007, 2 pages.
Twilight Labs, Frequently Asked Questions about UVision, website <available at http://www.decoypaint.com/category-s/19.htm>, Sep. 6, 2007, 7 pages.
Twilight Labs, Learn More, website <available at http://www.decoypaint.com/category-S/20.htm>, Sep. 6, 2007.
Nodak Outdoors, I need help testing a new goose hunting product, online forum <available at http://www.nodakoutdoors.com/forums/viewtopic.php?t=23942>, Sep. 30, 2007, 50 pages.
PASCO Scientific, UVA Light Sensor, Instruction Sheet for the PASCO Model Cl-9784, 1999.
Nick Knighton and Bruce Bugbee, A Mixture of Barium Sulfate and White Paint is a Low-Cost Substitute Reflectance Standard for Spectralon (R), study, Utah State University.
University of Bristol, Exploring the Fourth Dimension, Biological Sciences, journal <available at http://www.bio.brisc.ac.uk/research/vision/4d.htm>, Jul. 25, 2007, 5 pages.
John Pickrell, Urine Vision? How Rodents Communicate with UV Light, CASEB, journal <available at http://www.bio.puc.cl/caseb/adjuntos/mr_12_bozinovic_natgeogr.html>.
Roger N. Clark, Reflectance Spectra, American Geophysical Union, serial, 1995, pp. 178-188.
J. B. Schutt et al., Highly Reflecting Stable White Paint for the Detection of Ultraviolet and Visible Radiations, Applied Optics, article, Oct. 1974, pp. 2218-2221.
Tatsuya Kitade et al., Effects of Polymerization . . . Room-Temperature Phosphorimetry, Analytical Sciences, serial, Mar. 2002, pp. 337-341, vol. 18.
Charles Snapp, Looking for What You Can't See, Jul. 2004 Outdoors, website <available at http://www.724outdoors.com/Hunting/article_detail.asp?ArticleID=44>, Sep. 30, 2007, 2 pages.
Aero Outdoors, website <available at http://www.aerooutdoors.com/products/decoys/dz_buy_canadian.html>, Sep. 30, 2007, 5 pages.
Do you see what I see?, website <available at http://www.bellmuseum.org/eyes.html>, Sep. 30, 2007, 2 pages.
Stella Martin (Ed.), Tropical Tropics, serial, Mar. 2001, No. 65, Queensland Department of Environment and Heritage, Cairns, Queensland.
Cabela's, Avery (R) Ground Force Snow Cover, website <available at http://www.cabelas.com/cabelas/en/templates/li...=DD%Link&__requiestid=29289&-requestid=125235>, Sep. 30, 2007.
D.P. Young, Jr. et al., Comparison of Avian Responses to UV-Light-Reflective Pain on Wind Turbines, Subcontract Report, National Renewable Energy Laboratory, Jan. 2003.
Amber J. Keyser and Geoffrey E. Hill, Condition-dependent variation in the blue-ultraviolet coloration of a structurally based plumage ornament, The Royal Society, serial.
Decoy paint and UV, online forum <available at http://flocknockers.com/showthread.php?t=32337>, Sep. 30, 2007, 3 pages.
Final Approach snow covers / UV light, online forum <available at http://flocknockers.com/showthreads.php?t=28866>, Sep. 30, 2007, 4 pages.
Fool-a-Bird, website <available at http://www.foolabird.com/>, Sep. 30, 2007, 2 pages.
Fool-a-Bird, website <available at http://www.foolabird.com/index.php?page=stories>, Sep. 30, 2007, 2 pages.
John Beath, Increase Your Catch: See Like a Fish, Western Outdoors, magazine, May 2005, pp. 27-28.
Snow Cover Shine Problems??!!, online forum <available at http://flocknockers/showthread.php?t=19877>, Sep. 30, 2007, 6 pages.
Ben C. Sheldon et al., Ultraviolet colour variation influences blue tit sex ratios, Nature, Dec. 1999, pp. 874-877, vol. 402, Macmillan Magazines Ltd.
Andrew T. D. Bennett et al., Ultraviolet plumage . . . preferences in starlings, Birds & Lighting, report <available at http://users.mikrotec.com/~pthrush/lighting/upcmps.html>.
Robert Bleiweiss, Ultraviolet plumage reflectance distinguishes sibling birds species, PNAS, serial, Nov. 23, 2004, pp. 16561-16564, vol. 101, No. 47.
ATSKO, UV Protection, website <available at http://www.atsko/products/uv-protection/>, Sep. 30, 2007.
UV blocker detergent, online forum <available at http://flocknockers.com/showthread.php?t=20198>, Sep. 30, 2007, 3 pages.
UV rays, online forum <available at http://flocknockers.com/showthread.php?t=7342>, Sep. 30, 2007, 2 pages.
JWB Marketing LLC, ScareWindmill gees repeller, <retrieved from http://www.birdcontrolsuppplies.com/geescontrol1.htm May 13, 2008>, 2 pages.
JWB Marketing LLC, ScareWindmill for visual bird control, <retrieved from http://web.archive.org/web/20010217221510/www.birddamage.com/windbg.htm May 13, 2008>, 1 page.
Jonathan L. Tolstedt (Power of Attorney), Supplemental Information Disclosure Statement for U.S. Appl. No. 11/711,409, submitted to the USPTO on Mar. 22, 2008, 4 pages.

* cited by examiner

UV CAMOUFLAGE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hunting camouflage and more specifically it relates to a UV camouflage system for effectively camouflaging an individual or structure with respect to birds.

2. Description of the Related Art

Any discussion of the related art throughout the specification should in no way be considered as an admission that such related art is widely known or forms part of common general knowledge in the field.

The visible light spectrum for humans extends only between 400 nm to 700 nm. The light spectrum above 700 nm is not visible to humans and is comprised of infrared light. The light spectrum below 400 nm is also not visible to humans and is comprised of ultraviolet light. Ultraviolet light is usually identified by three general regions: UVA (310 nm to 400 nm), UVB (290 nm to 310 nm) and UVC (light below 290 nm).

Birds and other animals are able to see various wavelengths of light both visible and non-visible to humans. For example, waterfowl such as geese are able to view light in the visible light spectrum for humans and the non-visible light spectrum for humans (e.g. ultraviolet light spectrum).

Conventional camouflage is specifically designed to emulate the visible light spectrum of a landscape pattern which humans are able to see. For example, grass, corn stalks and other conventional landscape patterns using colors that are visible and that correspond to visible colors of the landscape pattern are often times used. Conventional camouflage accurately reflects light in the visible light spectrum (400 nm to 700 nm) which is visible to humans. However, conventional camouflage does not accurately reflect light in the UVA spectrum (310 nm to 400 nm) which is not visible to humans. This is a significant problem since birds, waterfowl and many other wild animals are able to see both the visible spectrum for humans and the non-visible UVA spectrum.

The main problem with conventional camouflage systems in use today is that they do not consider that animals, such as waterfowl, see various wavelengths of light that are visible and non-visible to the human eye. Hence, while a conventional camouflage pattern may appear to emulate the landscape pattern (e.g. a corn field, a wheat field, field grass, a slough, etc.) in the visible light spectrum, the conventional camouflage pattern often times will not emulate the landscape pattern in all light spectrums viewable by the animal attempted to be camouflaged against. FIG. 1*b* illustrates an exemplary conventional camouflage pattern used within tall grass which illustrates the hunter easily being viewed by a bird or other animal.

Some commercially available products (e.g. spray on liquids) that absorb ultraviolet light are sold to hunters because they reduce the reflection of ultraviolet light that is viewable to waterfowl. However, the usage of such products simply enhances the problems for hunters by not providing a realistic emulation of the landscape along all light spectrums because they actually block ultraviolet light that the surrounding landscape is actually reflecting.

In addition, camouflage items such as clothing will have water proofing applied to the exterior surface of the camouflage pattern. Because water proofing chemicals typically block ultraviolet light, exterior water proofing of camouflage items creates a problem similar to commercially available products that are intended to block ultraviolet light. Some hunting clothing have the water proofing applied to the interior of the clothing item, but this is done as a manufacturing choice and not because of water proofing modifies the light reflection properties of the camouflage pattern. In addition, water proofing chemicals applied to the interior portion are often times incorporated into the exterior portions thereby affecting the light reflection properties of the exterior surface.

Hence, conventional camouflage patterns are not as effective as they could be since they do not take into account the ability of birds and other animals to see light spectrums not viewable by humans. Because of the inherent problems with the related art, there is a need for a new and improved UV camouflage system for effectively camouflaging an individual or structure with respect to birds.

BRIEF SUMMARY OF THE INVENTION

The general purpose of the present invention is to provide a UV camouflage system that has many of the advantages of the conventional camouflage mentioned heretofore. The invention generally relates to a camouflage system which includes identifying a landscape pattern for camouflage, identifying the color and UV reflection properties of the landscape pattern, and printing a UV camouflage pattern on an item that emulates the color and UV reflection properties of the landscape pattern.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a UV camouflage system for effectively camouflaging an individual or structure with respect to birds.

Another object is to provide a UV camouflage system that may be utilized upon various items such as but not limited to clothing, camouflage sheeting, shelters, buildings, vehicles and the like.

An additional object is to provide a UV camouflage system that effectively provides camouflage with respect to various types of birds including but not limited to waterfowl.

A further object is to provide a UV camouflage system that may be formed to mimic various types of landscape patterns for all light spectrums viewable by birds and other animals.

Another object is to provide a UV camouflage system that provides an accurate recreation of a physical landscape as viewed by birds and other animals capable of seeing in the UV light spectrum.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 2B:
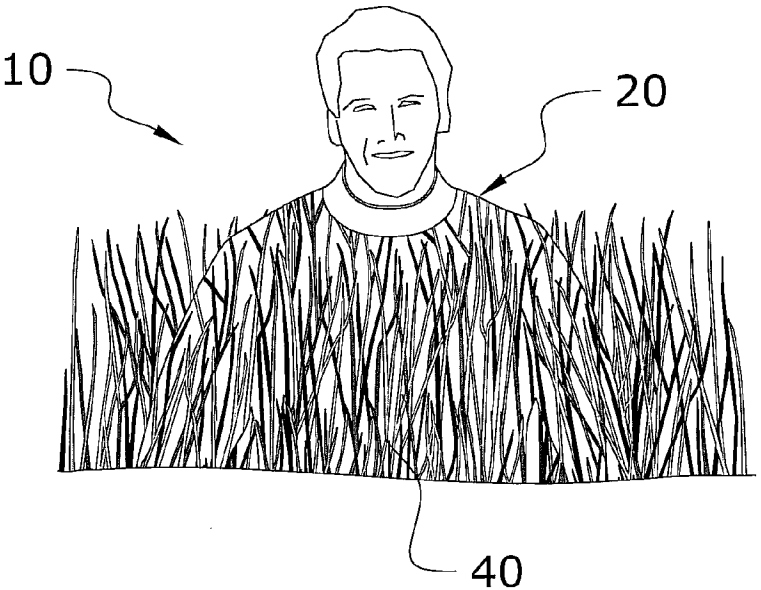
FIG. 2*b* is a front view of the shirt with the UV camouflage pattern of the present invention worn by an individual in surrounding landscape vegetation as viewed by a bird in all visible light spectrums.
Figure 2C:
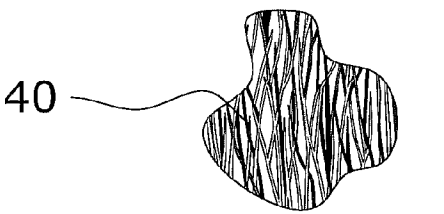
FIG. 2*c* is a magnified view of the UV camouflage pattern of the present invention as viewed by a bird.
Figure 2A:
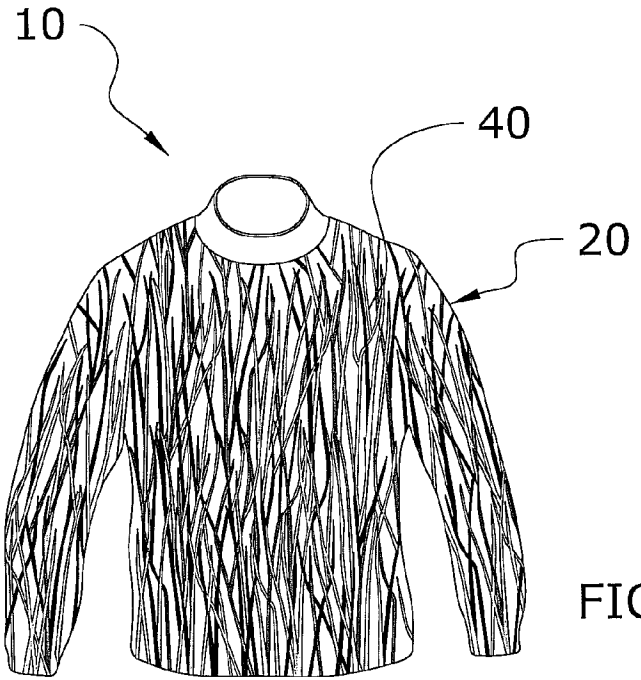
FIG. 2*a* is a front view of a shirt with the UV camouflage pattern of the present invention as viewed by a bird in all visible light spectrums.
Figure 3:
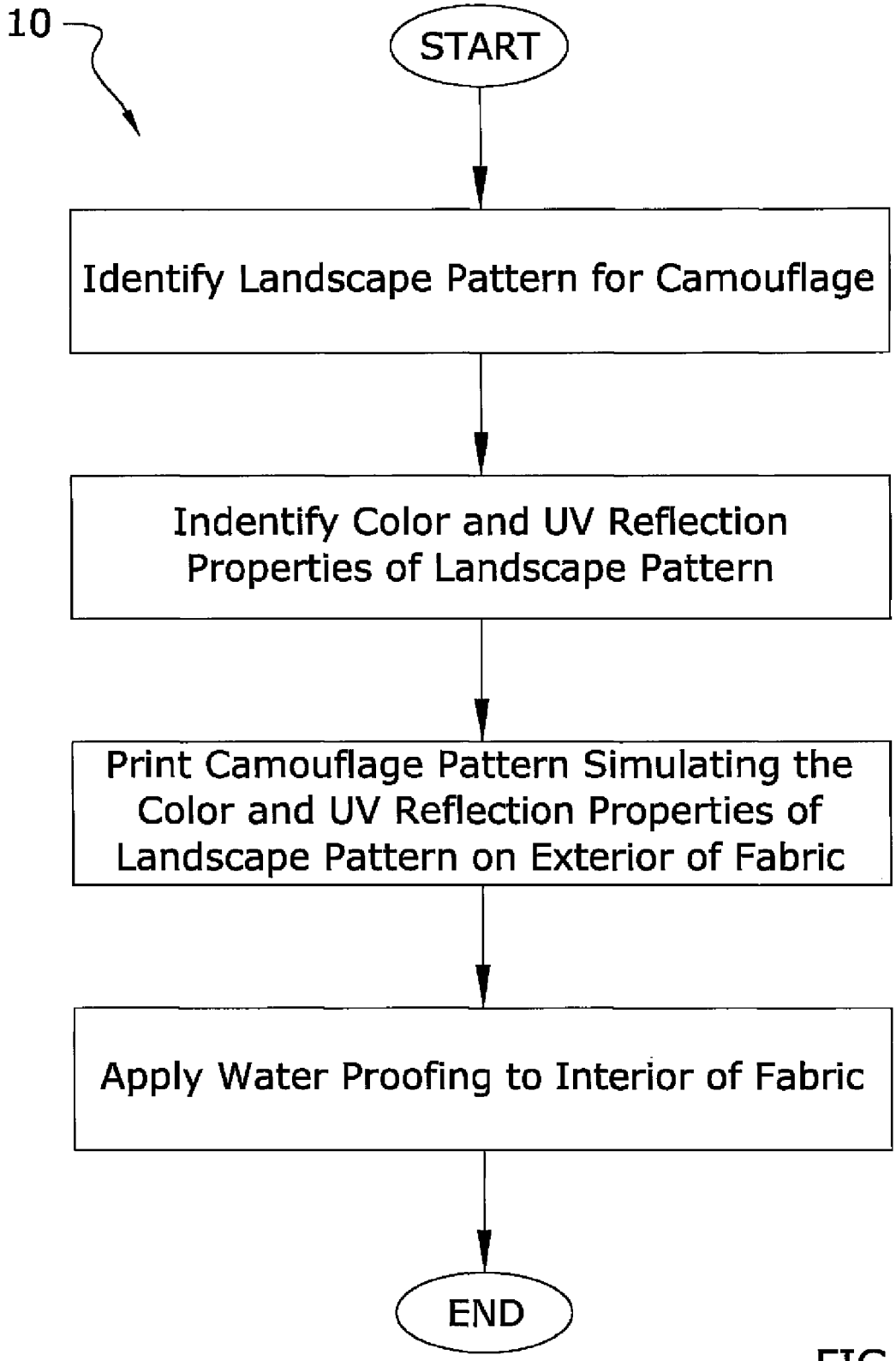
FIG. 3 is a flowchart illustrating the overall process of creating the UV camouflage pattern that emulates the landscape pattern in all light spectrums viewable by birds including the ultraviolet spectrum.

Turning now descriptively to the drawings, in which similar reference characters denote similar elements throughout the several views, FIGS. 1 through 3 illustrate a UV camouflage system 10, which comprises identifying a landscape pattern for camouflage, identifying the color and UV reflection properties of the landscape pattern, and printing a UV camouflage pattern 40 on an item that emulates the color and UV reflection properties of the landscape pattern.

B. Identifying Exterior Landscape.

The first step with the present invention is to identify an exterior landscape that is to be emulated for the camouflage pattern 40. It is desirable that the camouflage pattern 40 used on the item (e.g. clothing) have both the same visual pattern and light reflection properties as the exterior landscape to be emulated. The visual pattern is comprised of the visual shapes created by the exterior landscape (e.g. narrow blades of grass shapes, rounded leaves, thick corn stocks). The light reflection properties are comprised of both the visible light spectrum for humans (400 nm to 700 nm) and the non-visible light spectrum for humans that is still visible to birds (less than 400 nm).

For example, if a camouflage item 20 is to be used by a hunter in a tall grass area (e.g. a slough for ducks), a visual pattern comprised of elongated, narrow and tapering objects that cross one another is used as shown in FIGS. 2*a* through 2*c* of the drawings. Each of the objects for the visual pattern may be comprised of the same size (e.g. width and length) or a differing size. The objects are also orientated in a manner that emulates the real exterior landscape to be utilized in such as generally a vertical manner with some of the objects overlapping one another. Furthermore, the light reflection properties for the exterior landscape pattern is comprised of the objects each having individual light reflection properties. For example, some of the objects for the tall grass area may have a dark green color (e.g. 540 nm) in the visible light spectrum and a different wavelength reflection in the light spectrum below 400 nm (e.g. 335 mm) in the light spectrum not visible to humans. It can be appreciated that various other types of exterior landscapes may be used with the present invention such as but not limited to corn fields, grain fields (e.g. wheat, rice), lakes, snow covered fields, plowed fields, grass fields, sunflower fields, bean fields, and the like. The objects represented in the visual pattern may include but are not limited to grass, corn stalks, ears of corn, grain stalks, water, sunflower heads and the like.

A conventional optical measuring tool may be used to measure the light reflection properties of the exterior landscape and its individual objects to be emulated such as but not limited to a spectrometer or spectrograph. The optical measuring tool is used to measure the light reflection properties in both the visible and non-visible light spectrums for humans but still measures all light spectrums visible to animals such as birds (e.g. waterfowl).

C. Identifying Camouflage Pattern.

Figure 1B:
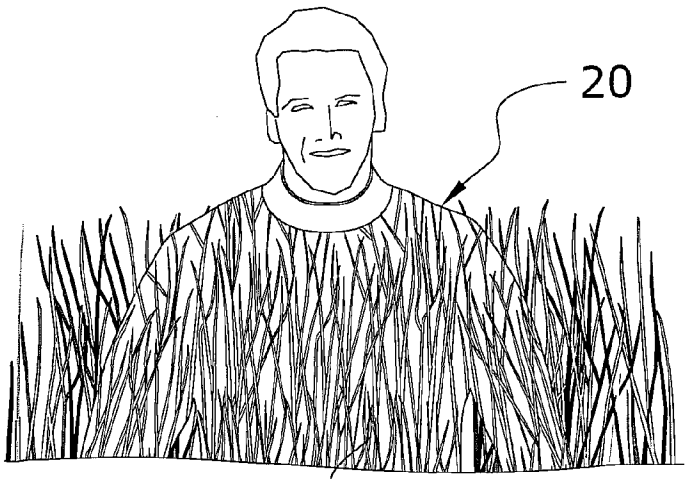
FIG. 1b (Prior Art)
FIG. 1*b* is a front view of the prior art camouflage worn by an individual in surrounding landscape vegetation as viewed by a bird in all visible light spectrums.
Figure 1C:
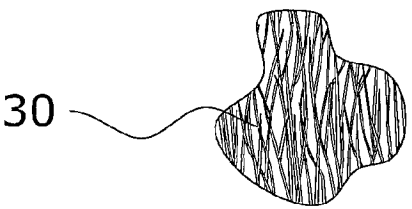
FIG. 1c (Prior Art)
FIG. 1*c* is a magnified view of the prior art camouflage as viewed by a bird.
Figure 1A:
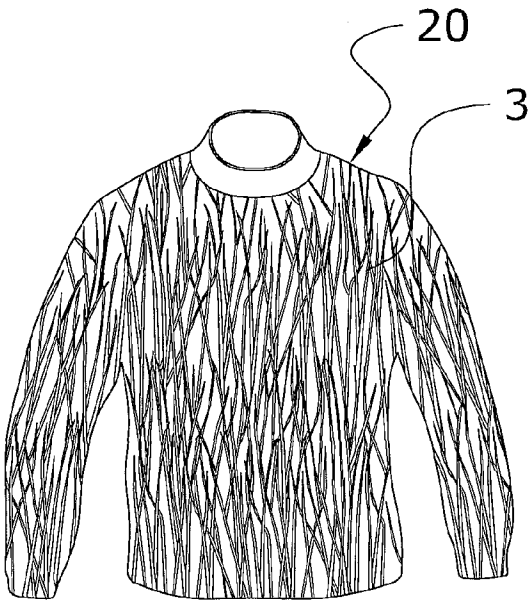
FIG. 1a (Prior Art)
FIG. 1*a* is a front view of a prior art camouflage shirt as viewed by a bird in all visible light spectrums.

After the visual pattern and the light reflection properties of the exterior landscape has been identified by the optical measuring tool, a camouflage pattern 40 is generated that closely emulates the visual pattern and/or the light reflection properties of the exterior landscape. It is preferable that the camouflage pattern 40 emulate both the visual pattern and the light reflection properties of the exterior landscape to provide a realistic emulation of the exterior landscape that the camouflage item 20 will be used. FIGS. 1*a* through 1*c* illustrate a conventional camouflage pattern 30 that has the desired visual pattern but does not have the accurate light reflection properties in all light spectrums visible to birds and other wild animals.

After the camouflage pattern 40 is identified using the visual pattern and the light reflection properties of the exterior landscape, the coatings needed to recreate the exterior landscape in the camouflage pattern 40 are then identified and selected. The coatings used to create the camouflage pattern 40 may be comprised of any types of ink or paint that is able to emulate the light reflection properties of the exterior landscape in all light spectrums visible to birds (e.g. waterfowl) and any other animals attempted to be concealed from by an individual (e.g. hunter, photographer). The coatings may be applied to the camouflage item 20 utilizing any conventional application process.

Alternatively, if a fabric material is to be utilized for the camouflage item 20, then the fabric may be woven in such a manner so as to create the camouflage pattern 40 upon the exterior surface thereof. The fabric material is selected that has the light reflection properties required to emulate the light reflection properties of the exterior landscape and then the fabric materials are combined in a manner that emulates such light reflection properties and the visual pattern of the exterior landscape pattern. It is preferable to utilize a plurality of fabric materials each having different light reflection properties to accurately emulate the exterior landscape.

D. Applying Camouflage Pattern to Item.

The camouflage item 20 may be comprised of various types of items such as but not limited to clothing (e.g. shirts, jackets, pants, vests, hats, gloves, face masks, snow suits, overalls, shoes and the like), sheets of camouflage material or fabric, hunting blinds, buildings, vehicles (e.g. ATV, truck) and the like. If the camouflage item 20 has a relatively smooth surface or a surface that can be printed upon, it is preferable that the camouflage pattern 40 be printed upon the exterior surface of the camouflage item 20.

Various types of conventional printing technologies may be used to print the camouflage pattern 40 on the exterior surface of the camouflage item 20 that are able to recreate the camouflage pattern 40 (e.g. manual painting, screen printing, digital printing). The camouflage pattern 40 is printed upon the item in such a manner that visually recreates and emulates the visual pattern and light reflection properties (for all light spectrums visible to birds such as waterfowl) of the exterior landscape to be used in.

E. Water Proofing Applied to Interior of Item.

After the camouflage item 20 is created with the camouflage pattern 40 (or before the camouflage pattern 40 is applied), a water proofing chemical is preferably applied to the camouflage item 20 to protect the item and the user against rain and other sources of water (e.g. for clothing). It is preferable to apply the water proofing chemical only to an interior surface of the item as is well known in the art, but in a manner where the water proofing is not applied to the camouflage pattern 40 on the exterior surface of the camouflage item 20. In particular, the application of the water proofing chemical is such that the water proofing chemical does not significantly change the light reflection properties of the camouflage pattern 40 of the camouflage item 20 after the manufacture thereof.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A method of producing a camouflage item that accurately emulates light reflection in all light spectrums viewable to birds, said method comprising the steps of:

identifying an exterior landscape to be emulated for camouflage;

identifying a landscape pattern for said exterior landscape, wherein said landscape pattern is comprised of a first light spectrum visible to humans and a second light spectrum not visible to humans;

wherein said second light spectrum is comprised of ultraviolet light;

identifying the light reflection properties of said landscape pattern, wherein said light reflection properties includes both said first light spectrum and said second light spectrum;

determining a camouflage pattern that closely emulates said light reflection properties; and applying said camouflage pattern to an exterior surface of an item.

2. The method of producing a camouflage item of claim 1, wherein said step of applying said camouflage pattern is comprised of printing said camouflage pattern onto said item.

3. The method of producing a camouflage item of claim 2, including the step of identifying a plurality of coatings that emulate said light reflection properties of said landscape pattern.

4. The method of producing a camouflage item of claim 3, wherein said step of applying said camouflage pattern applies said plurality of coatings to said item using said camouflage pattern.

5. The method of producing a camouflage item of claim 3, wherein said plurality of coatings are comprised of ink.

6. The method of producing a camouflage item of claim 3, wherein said plurality of coatings are comprised of paint.

7. The method of producing a camouflage item of claim 1, wherein said item is comprised of an article of clothing.

8. The method of producing a camouflage item of claim 1, including the step of applying a water proofing chemical to said item in a manner that is not applied to said camouflage pattern and that does not significantly change the light reflection properties of said camouflage pattern.

9. The method of producing a camouflage item of claim 8, wherein said step of applying a water proofing chemical to said item includes applying said water proofing chemical to only an interior surface of said item.

10. A method of producing a camouflage item that accurately emulates light reflection in all light spectrums viewable to birds, said method comprising the steps of:

identifying an exterior landscape to be emulated for camouflage;

identifying a landscape pattern for said exterior landscape, wherein said landscape pattern is comprised of a first light spectrum visible to humans and a second light spectrum not visible to humans;

wherein said second light spectrum is comprised of ultraviolet light;

identifying the light reflection properties of said landscape pattern, wherein said light reflection properties includes both said first light spectrum and said second light spectrum;

determining a camouflage pattern that closely emulates said light reflection properties; and creating an item having an exterior surface comprised of said camouflage pattern.

11. The method of producing a camouflage item of claim 10, wherein said step of creating an item is comprised of selecting fabric material and combining said fabric material in a manner that emulates said light reflection properties of said landscape pattern.

12. The method of producing a camouflage item of claim 11, wherein said fabric material is comprised of a plurality of fabric materials that have different light reflection properties.

13. The method of producing a camouflage item of claim 10, wherein said item is comprised of an article of clothing.

14. The method of producing a camouflage item of claim 10, including the step of applying a water proofing chemical to said item in a manner that does not significantly change the light reflection properties of said camouflage pattern.

15. The method of producing a camouflage item of claim 14, wherein said step of applying a water proofing chemical to said item includes applying said water proofing chemical to only an interior surface of said item.

16. A method of producing a camouflage item that accurately emulates light reflection in all light spectrums viewable to birds, said method comprising the steps of:

identifying an exterior landscape to be emulated for camouflage;

identifying a landscape pattern for said exterior landscape, wherein said landscape pattern is comprised of a first light spectrum visible to humans and a second light spectrum not visible to humans, wherein said second light spectrum is comprised of ultraviolet light;

identifying the light reflection properties of said landscape pattern, wherein said light reflection properties includes both said first light spectrum and said second light spectrum;

identifying a plurality of coatings that emulate said light reflection properties of said landscape pattern;

determining a camouflage pattern that closely emulates said light reflection properties;

printing said camouflage pattern onto an exterior surface of an item, wherein said item is comprised of an article of clothing; and applying a water proofing chemical only to an interior surface of said item in a manner that is not applied to said camouflage pattern and that does not significantly change the light reflection properties of said camouflage pattern.

17. The method of producing a camouflage item of claim 16, wherein said step of printing said camouflage pattern applies said plurality of coatings to said item using said camouflage pattern.

18. The method of producing a camouflage item of claim 16, wherein said plurality of coatings are comprised of ink or paint.

* * * * *